United States Patent [19]

Herrington et al.

[11] 4,028,907

[45] June 14, 1977

[54] ADJUSTABLE-JOULE-THOMSON CRYOGENIC COOLER WITH DOWNSTREAM THERMAL COMPENSATION

[75] Inventors: Rodney E. Herrington, Dallas; Carol O. Taylor, Anna, both of Tex.

[73] Assignee: Texas Instruments Incorporated, Dallas, Tex.

[22] Filed: Dec. 15, 1975

[21] Appl. No.: 640,524

[52] U.S. Cl. ..... 62/222; 62/514 JT

[51] Int. Cl.[2] ..... F25B 41/04

[58] Field of Search ..... 236/101 R, 101 E; 62/222, 514 JT

[56] References Cited

UNITED STATES PATENTS

| | | | |
|---|---|---|---|
| 3,320,755 | 5/1967 | Jepsen et al. | 62/514 JT |
| 3,691,784 | 9/1972 | Nicholds et al. | 62/514 JT |
| 3,800,552 | 4/1974 | Sollami et al. | 62/514 JT |

*Primary Examiner*—Ronald C. Capossela
*Attorney, Agent, or Firm*—Harold Levine; Rene' E. Grossman; Alva H. Bandy

[57] ABSTRACT

An adjustable Joule-Thomson cryogenic cooler with a downstream thermal compensation mechanism is taught. The cryogenic cooler includes a cryogen source coupled to a manifold input port, the manifold input port connected to a heat exchanger, the heat exchanger coupled to an orifice block, and the orifice block connected to an expansion chamber. A thin cylindrical tube is attached to the manifold to support the heat exchanger. The expansion chamber is defined by the orifice block, the exterior surface of the cylindrical tube, a portion of the interior of the cylindrical tube in communication with the exterior surface of the cylindrical tube through passages, a dewar stem, and a portion of the manifold. The dewar stem encloses the cylindrical tube and sealingly engages the manifold. The thermal compensation mechanism includes a bimetal cantilever in the expansion chamber portion of the cylindrical tube, an adjustment mechanism for adjusting the effective bimetal cantilever, and a needle valve mechanism. The needle valve mechanism includes a needle valve for the orifice of the orifice block. In operation cryogen passes from the source through the manifold input port and heat exchanger to the orifice. The pressure of the cryogen opens the needle valve and cryogen enters the expansion chamber. The cryogen expands as it leaves the orifice to form a cold end for the expansion chamber, and a thermal gradient as it moves downstream over the heat exchanger to the hot end of the expansion chamber. As the cryogen moves downstream a portion enters and leaves the cylindrical tube through its passages to cool the bimetal cantilever which bends as it cools to engage and end of a bell crank mounted in the orifice block. The other end of the bell crank engages the needle valve carriage to seat the needle valve in the orifice to stop the flow of cryogen into the expansion chamber. From the hot end of the expansion chamber, the cryogen vents through a manifold output port and vent tube. As the temperature of the expansion chamber rises, the bimetal strip returns to its original position permitting the cryogen under pressure to unseat the needle valve to enter the expansion chamber.

12 Claims, 6 Drawing Figures

ADJUSTABLE-JOULE-THOMSON CRYOGENIC COOLER WITH DOWNSTREAM THERMAL COMPENSATION

This invention relates to an improved cryogenic cooler, and more particularly, to a cryogenic cooler having an adjustable downstream thermal compensation mechanism.

In the past, cryogenic coolers operating on the Joule Thomson principle, that is, where high pressure cryogen is permitted to expand and pass over a heat exchanger to cool the cryogen in the heat exchanger to its boiling point, have utilized a bellows actuated needle valve as a temperature control mechanism. The bellows includes a gas filled chamber. When the gas in the bellows chamber cools, the bellows contracts to close the valve.

Several disadvantages attend the use of a bellows controlled valve mechanism. For example, the bellows of the bellows mechanism may leak gas and become ineffective in manipulating the valve controlling entry of the cryogen into the expansion chamber. For another example, the bellows mechanism might be affected by pressure variations at the cold end of the expansion chamber; such pressure variations affect the dynamics of the gas flow and reduce the efficiency of the cryogen cooler. As another example, the bellows mechanism cannot be calibrated for different cryogens without disassembling the cryogen cooler; the adjustment of the bellows mechanism is difficult and time consuming. Finally, fabrication of a suitable bellows; e.g., one that will operate properly at cryogenic temperatures, is relatively expensive and complicated.

Accordingly, it is an object of the present invention to provide an improved cryogenic cooler.

Another object of the invention is to provide an improved thermal compensation mechanism for a cryogenic cooler.

A further object of the invention is to provide a thermal compensation mechanism for a cryogenic cooler which is simple to fabricate, reduces the thermal mass, and which lends itself to mass production techniques for economical production.

Still another object of the invention is to provide a thermal compensation mechanism for a cryogenic cooler which is capable of adjustment to insure operation at a preselected temperature and which can be calibrated for use with different cryogens.

Still a further object of the invention is to provide a thermal compensation mechanism which is independent of pressure forces at the cold end of the expansion chamber.

Still yet another object of the invention is to provide a thermal compensation mechanism which is not susceptable to gas leaks.

Still yet a further object of the invention is to provide a thermal compensation mechanism downstream of the cold end to bring the heat exchanger closer to the cold end for greater thermal sensitivity, increased efficiency and substantially constant cold end temperature.

Briefly stated, the improved cryogen cooler comprises a pressurized source of cryogen coupled to a heat exchanger. A needle valve controlled orifice attached to the heat exchanger admits the pressurized cryogen into an expansion chamber. A mechanically actuated valve means meters the cryogen passing through the orifice into the expansion chamber responsive to an adjustable thermal mechanism. The adjustable thermal mechanism is positioned selectively in the expansion chamber downstream of the cold end where it is responsive to the temperature of the expanded cryogen at that point only to maintain the cold end of the cooler at a preselected temperature.

The novel features believed to be characteristic of this invention are set forth in the appended claims. The invention itself, however, as well as other objects and advantages thereof may best be understood by reference to the following detailed description of an illustrative embodiment when read in conjunction with the accompanying drawings in which:

Figure 1:
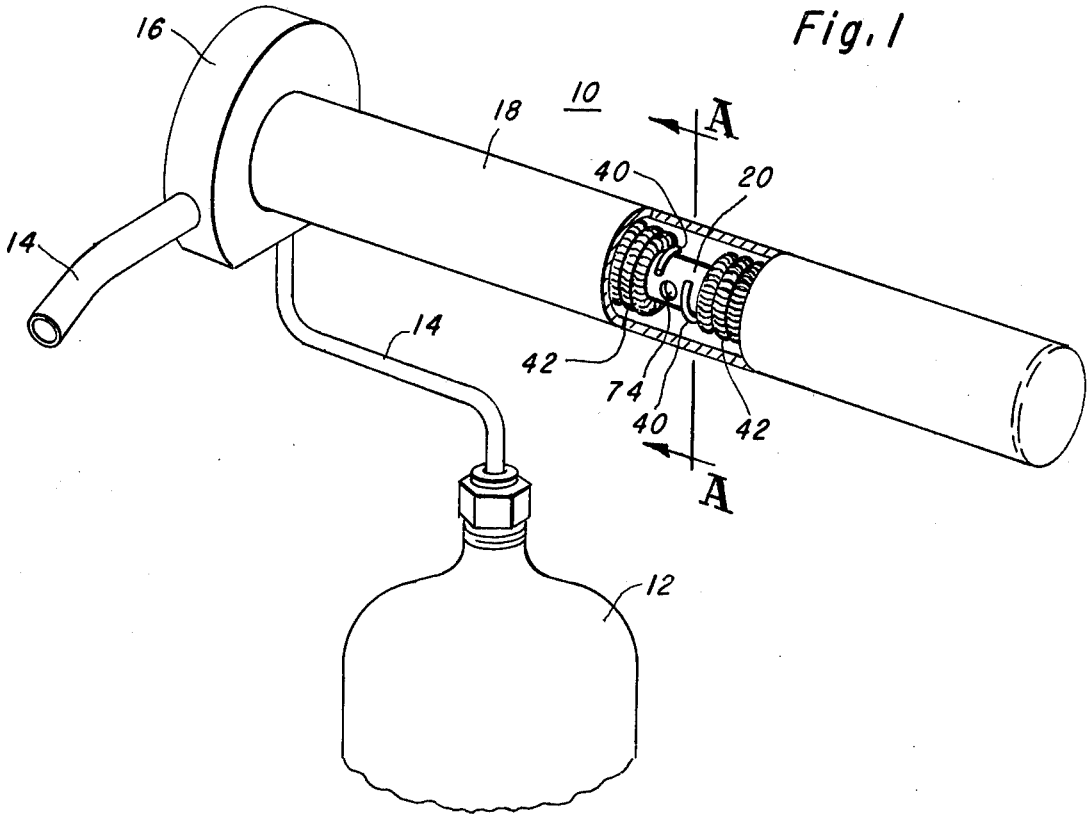
FIG. 1 is an isometric view of the cryogenic cooler with a portion cut away to show in more detail the cryogenic cooler constituting the subject matter of this invention.

Referring now to FIG. 1 in which there is shown a cryogenic cooler 10 which may be, for example, a Joule-Thomson type cryostat. Cryostat 10 includes a pressurized source of cryogen 12 which in the preferred embodiment is, for example, a bottle of air pressurized to about 6,000 psi. A conduit 14 connects the pressurized bottle 12 to a manifold 16. A dewar stem 18 and a surface of the manifold 16 encloses the cryogen cooler working mechanism 20, more fully described herinafter, with one end sealingly engaging the manifold 16. The space between the dewar stem 18 and the working mechanism 20 forms a position of an expansion chamber 22, also more fully described hereinafter. The expansion chamber 22 is vented through a vent tube 24 attached to the manifold 16.

Figure 2:
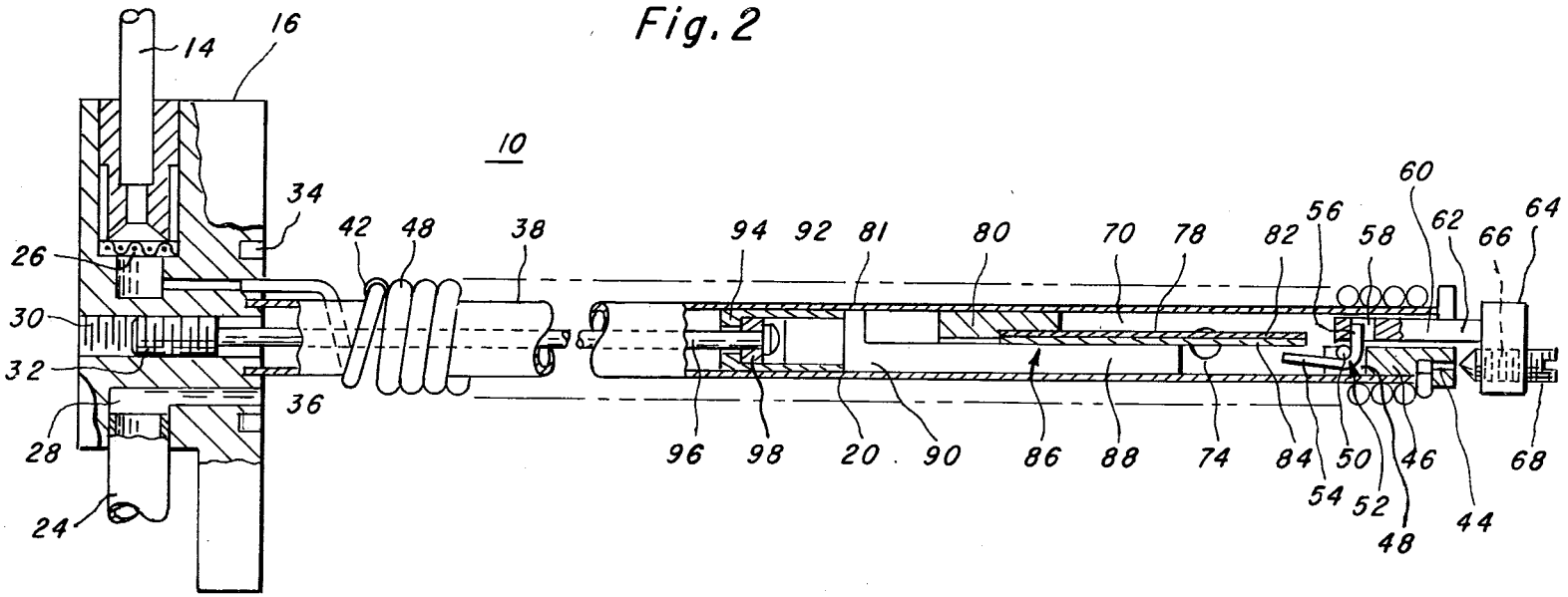
FIG. 2 is a plan view, partly in section, of the cryogenic cooler showing the thermal compensation mechanism in the inoperative position.

Referring now to FIG. 2 in which there is shown the cryogenic cooler of FIG. 1 with the cryogen source 12 and dewar stem 18 (FIG. 1) removed to more clearly show the details of the manifold 16, and cooler working mechanism 20. The manifold 16 (FIG. 2) has an input port 26 coupled to the cryogen supply tube 14 and an output port 28 coupled to the vent tube 24. A threaded passage 30 is centrally disposed in the manifold 16 to receive an adjustment set screw 32 of an adjustment mechanism, hereinafter more fully described, for a thermal compensating mechanism. An "O" ring groove 34 is formed in the manifold 16 to receive the dewar stem 18. The annular O ring groove 34 is concentric to the threaded passage 30. A stepped boss 36 is formed for receiving a cylindrical tube 38. The stepped boss 36 has a passage corresponding to the threaded passage 30 which forms an extension thereof into the cylindrical tube 38.

The cooler working mechanism 20 includes a heat exchanger 40 having one end connected to supply port 26 of the manifold 16. The heat exchanger 40 may be, for example, a copper tube having a spiral flange 42 integral therewith. The spiral flange 42 acts as a heat sink for the heat exchanger 40. The heat exchanger 40 is wrapped around the cylindrical tube 38 and terminates at an orifice 44 formed in an orifice block 46. The orifice block 46 is preferrably, for example, a nickel block forming in cross section a truncated semi-circle. The orifice block 46 has a two-way opening slot 48 formed in an end portion thereof opposite the orifice 44. A pin 50 is journaled in the orifice block walls forming the slot 48 and a bell crank 52 is mounted for rotation with the pin 50. The bell crank 52 has one arm portion 54 extending through an opening in the end of the orifice block 46 for vertical movement within the cylindrical tube 38, for a purpose hereinafter described, and a second arm portion 56 extending upwardly through an opening in the major flat surface of the orifice block 46 for substantially horizontal movement within a slot 58 formed in an end portion of a horizontal member 60 of needle valve carriage 62.

The needle valve carriage member 60 is in cross section a truncated circular member with its major flat surface corresponding with the major flat surface of the orifice block 46 upon which it slides responsive to the movement of bell crank 52. Needle carriage member 60 supports at its end opposite its slotted end a solid cylindrical member 64. For purposes of reducing thermal mass, opposite parallel vertical sides may be formed by removing portions of the cylindrical member 64. Truncated cylindrical member 64 has a threaded passage 66 in which a needle valve 68 is threadedly mounted for adjustment. The needle valve 68 is positioned to seat in the orifice 44 of orifice block 46. The truncated semi-circular member 60 and truncated circular member 64 are fabricated of any suitable material such as, for example, stainless steel.

Figure 3:
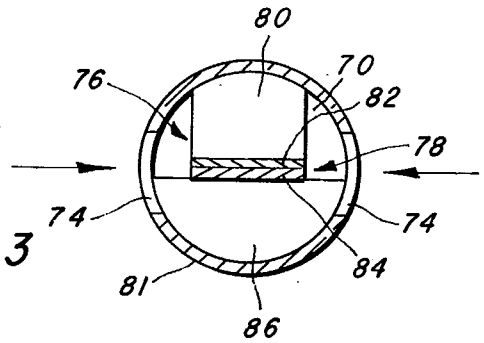
FIG. 3 is a cross-sectional view of the cryogenic cooler taken along section A—A of FIG. 1.
Figure 4:
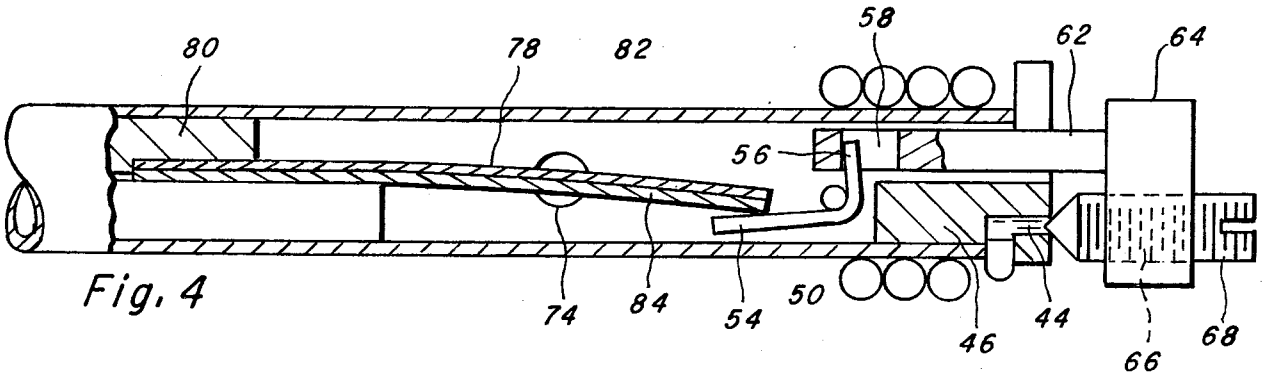
FIG. 4 is a partial view of the cryogenic cooler showing the thermal compensation mechanism in the closed position.

The orifice of orifice block 46 communicates with the expansion chamber 22 (FIG. 1). The expansion chamber 22 includes the area between the dewar stem 18 and the cylindrical tube 38 and a portion 70 (FIG. 2) within the cylindrical tube as hereinafter more fully described. Thus, the expansion chamber includes the cold end portion between the vertical ends of the cylindrical tube 38 and the dewar stem 18, the portion between the horizontal walls of the cylindrical tube 38 and the dewar stem 18 which enclose the heat exchanger 40 in addition to the interior portion 70 of the cylindrical tube. The expansion chamber terminates with a hot end at the output port 28 of the manifold 16. An increasing thermal gradient extends along the expansion chamber between the cold and hot ends. The expansion chamber portion 70 within the cylindrical tube 38 is in communication with the portion of the expansion chamber defined by the horizontal walls of the cylindrical tube 38 and the dewar stem 18 through apertures 72 and 74 (FIG. 3). The apertures 72 and 74 are selectively positioned downstream from the cold end of the cylindrical tube 38 substantially at the transition point (liquid to gas) for the highest supply pressure to admit cooled cryogen, into portion 70 of expansion chamber 22 in the cylindrical tube to cool the thermal compensation mechanism 76. As the supply pressure decreases, the transition point moves closer to the cold end, the temperature of the control mechanism 76 increases, and the force the control mechanism exerts on the needle valve 68 is reduced to increase the cryogen flow to maintain cold end temperature.

The thermal compensation mechanism 76 is positioned within the cylindrical tube 38 and includes a bimetal strip 78 having one end rigidly attached to a semi-circular block member 80 rigidly attached to the interior surface of the cylindrical tube 38. The bimetal strip 79 consists of two laminated layers of metal alloys 82 and 84 having different coefficients of expansion. Suitable metal alloys are: for layer 82, a low expansive nickel alloy sold under the trademark INVAR by Firth Sterling Co.; and for layer 84, a high expansive alloy comprising 72% magnesium, 18% copper, and 10% nickel. An adjustment slide member 86 has a portion 88 of semi-circular cross section whose flat surface corresponds to that of the bimetal strip 78 and bimetal strip holder 80, and an end portion 90 having a circular cross section corresponding to the interior surface of the cylindrical tube 38. The circular end portion 90 of the adjustment slide 86 terminates in a boss 92. A cylindrical cup shaped member 94 has its lip portion rigidly attached to the boss 92 and a passage formed in the bottom thereof. A rod 96 having a flanged end rigidly secured in a retaining member 98 rigidly mounted within the cylindrical cup 94 is attached to the adjustment set screw 32 threadedly mounted in passage 30 of manifold 16. The end of bimetallic strip 78, opposite the bimetal strip supporting block 80, is positioned to engage bell crank 52.

Figure 5:
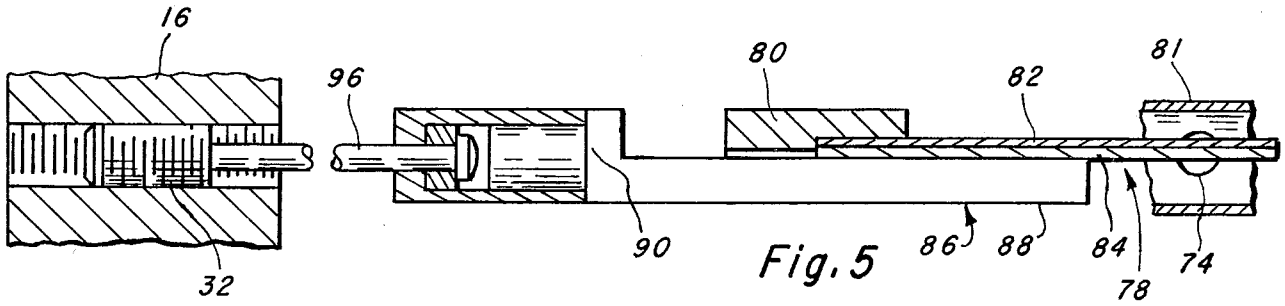
FIG. 5 is a partial view partly in section showing the fulcrum adjustment mechanism, for the thermal compensation means, in the advanced position.
Figure 6:
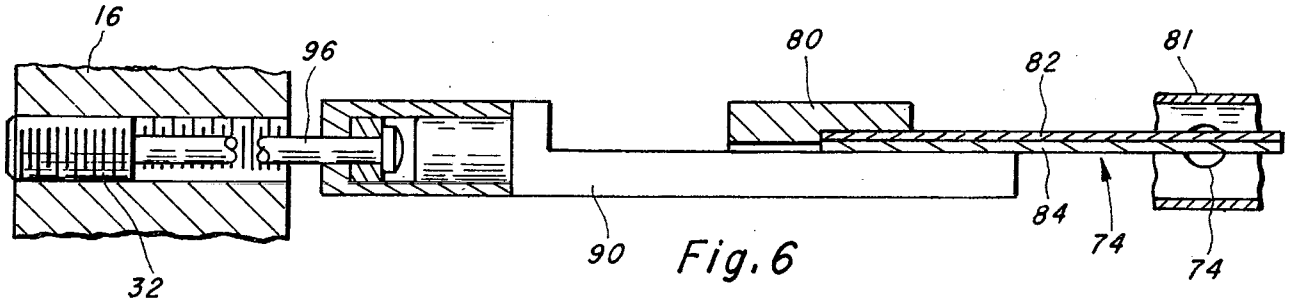
FIG. 6 is a partial view partly in section of the fulcrum adjustment mechanism, for the thermal compensation means, in the retracted position.

For operation the set screw 32 (FIG. 5) of the thermal compensation adjustment mechanism is turned to drive rod 96 to properly position the slide member 86 beneath the bimetal strip 78. The end of slide member 86 acts as a fulcrum whose action is to adjust the flexiblity of the bimetal strip 78 to obtain in the desired cold end temperature for the cryogen used. As shown in FIG. 5, the slidable fulcrum member 88 is advanced to decrease the flexibility of the bimetal strip 78 and as shown in FIG. 6 is retracted to increase the flexibility of the bimetal strip. Further adjustment is made through the needle valve 68 to adjust the position of the bell crank 52 as to bimetal strip 78. The apertures 72 and 74 are located through trial and error to obtain a location where the temperature of the cryogen in the expansion chamber is affected substantially only by the temperature of the cold end rather than the ambient temperature of the hot end. With the slide member 88 and the needle valve properly adjusted to provide the desired temperature at the cold end of the expansion chamber, (e.g., 77° K for a mercury cadmium telluride detector) the cryogenic cooler is ready for use in cooling a dewar.

In operation cryogen from the source 12 is passed through the input port 26 of the manifold 16, and heat exchanger 40, to the orifice. The pressure of the cryogen forces the needle carriage 62 back to unseat the needle valve 68. The slot 48 in the orifice block acts as a stop for the bell crank 52 to limit outward movement of the needle carriage. With the needle valve 68 unseated the cryogen enters the cold end of the expansion chamber where upon expansion it is cooled down to a liquid and flows down the expansion chamber over the heat exchanger to extract heat from the cryogen passing through the heat exchanger. As the liquid cryogen flows downstream, the transition point of the thermal gradient is passed and the cryogen as a gas enters portion 70 of the expansion chamber 22 though passages 72 and 74 to cool the bimetal strip 78. As the bimetal strip 78 cools in response to the temperature of cryogen, it deflects to engage and depress arm 54 of bell crank 52. As arm 54 of bell crank 52 is depressed, the other arm 56 moves against a side of needle carriage slot 58 to seat needle valve 68 in the orifice 44 of orifice block 46 to cut-off the flow of cryogen into the expansion chamber 22. With the flow of gas cut-off from the expansion chamber, the temperature of the cryogen in the expansion chamber increases and with the increase in temperature, the bimetal strip 78 relaxes to return to its normal or non-deflected position. It will be appreciated that as the cryogen supply decreases the pressure decreases and the amount of cryogen for cooling increases. As the amount of cryogen for cooling increases, the response of the metal strip adjusts correspondingly and the resulting action of the metal strip is such to maintain its operation in accordance with the decreasing pressure of the cryogen source. As the cryogen continues downstream to the hot end of the expansion chamber, it is vented to the atmosphere through vent tube 24 attached to the output port 28 of manifold 16.

Although only a single embodiment of this invention has been described herein, it will be apparent to a person skilled in the art that various modifications to the details of the construction shown and described may be made without departing from the scope of this invention.

What is claimed is:

1. A cryogenic cooler comprising:

a. source of cryogen;

b. a heat exchanger connected to the source of cryogen;

c. a valve means attached to the heat exchanger for controlling the flow of cryogen from the heat exchanger;

d. an expansion chamber having a cold end, a body portion and a hot end, said cold end connected to the heat exchanger for receiving and expanding the cryogen flowing from the heat exchanger, said body portion having a length sufficient to receive the flowing cryogen for absorbing heat from the heat exchanger to form a thermal gradient between the cold and hot ends, and said hot end formed at the hot end of the body portion for venting the heated cryogen; and e. a thermal compensation mechanism positioned downstream of the cold end at a preselected location in the body portion of the expansion chamber, said thermal compensation mechanism connected to the valve means for actuating the valve means responsively to a selected temperature of the thermal gradient whereby the thermal compensation mechanism is independent of the pressure forces at the cold end of the expansion chamber and the cold end is maintained at a substantially constant preselected temperature.

2. A cryogenic cooler according to claim 1 wherein said thermal compensation mechanism includes adjustment means for adjusting response of the thermal compensation mechanism for use with different cryogens.

3. A cryogenic cooler according to claim 1 wherein said expansion chamber comprises a cylindrical tube forming an inner wall of the expansion chamber, a dewar stem in a spaced relationship to the inner wall to form an outer wall of the expansion chamber, and vented end closing means.

4. A cryogenic cooler according to claim 3 wherein the heat exchanger is supported by the cylindrical tube within the expansion chamber.

5. A cryogenic cooler according to claim 4 wherein the cylindrical tube houses a thermal compensation mechanism in communication with the expansion chamber, a needle valve carriage, and an orifice block having an orifice with ends in communication with the heat exchanger and expansion chamber.

6. A cryogenic cooler according to claim 5 wherein the thermal compensation mechanism comprises a bimetal cantilever for bending responsive to temperature changes, and an adjustable fulcrum member mounted for engaging the bimetal cantilever between its ends for adjusting the flexibility of the bimetal strip.

7. A cryogenic cooler according to claim 5 wherein said cylindrical tube further houses the adjustment mechanism for the thermal compensation mechanism.

8. A cryogenic cooler according to claim 7 wherein the adjustment mechanism is positioned in one end portion of the cylindrical tube, the thermal compensation mechanism is positioned within the cylindrical tube adjacent the adjustment mechanism end portion, and the needle valve carriage and orifice block are positioned within the end portion of the cylindrical tube opposite the end portion containing the thermal compensation mechanism adjustment mechanism.

9. A cryogenic cooler mechanism according to claim 3 wherein said vented end expansion chamber closing means comprises a manifold having a surface adapted to receive the dewar and open end of the cylindrical tube, an input port for receiving cryogen from a source thereof, an output port for venting the expansion chamber, a threaded passage, and a threaded set screw threadedly mounted in the threaded passage and coupled to the thermal compensation mechanism adjustment mechanism.

10. A cryogenic cooler comprising:

a. a source of cryogen;

b. a heat exchanger including a conduit, a support tube, and an orifice, the conduit wrapped around the support tube and having an inlet connected to the source of cryogen and an outlet connected to the orifice;

c. a valve means having a valve seat formed in the heat exchanger orifice and a valve corresponding with the valve seat for regulating the flow of cryogen from the heat exchanger;

d. an expansion chamber tube having a closed end portion, a body portion and an open end, the expansion chamber tube enclosing the heat exchanger with the heat exchanger conduit outlet and valve means opening into the closed end portion of the expansion chamber to admit cryogen from the source thereof to form a cold end, the body portion having a length sufficient to form a transition point whereby the cryogen flowing from the cold end through the body portion absorbs heat from the heat exchanger conduit to change form for venting at the open end; and e. a thermal compensation mechanism selectively positioned in the heat exchanger conduit supporting tube, said thermal compensation mechanism having a bimetallic strip in communication with the expansion chamber substantially at the transition point, a support, the bimetallic strip and support forming a cantilever, a valve actuator operatively engaging the cantilever and valve responsively to cantilever movement for adjusting the position of the valve as to its valve seat, whereby the thermal compensation mechanism is independent of pressure forces at the cold end of the expansion chamber, is located to bring the heat exchanger closer to the cold end, and is located at the transition point to provide a substantially constant cold end temperature.

11. A cryogenic cooler according to claim 10 wherein said valve means comprises:

a needle valve adapted to seat in the heat exchanger orifice and a slide member slidably supporting the needle valve, and wherein said valve actuator comprises a bell crank having one arm engaging the slide member for slidably moving the slide member, and a second arm engaging the bimetal cantilever for moving the bell crank responsive to temperature changes within the expansion chamber.

12. A cryogenic cooler comprising:

a. a source of cryogen;

b. a heat exchanger connected to the source of cryogen;

c. an expansion chamber connected to the heat exchanger for expanding the cryogen passing through the heat exchanger; and d. an adjustable control means for controlling the flow of cryogen from the heat exchanger into the expansion chamber which comprises: a needle valve adapted to seat in the heat exchanger cryogen outlet, a slide member slidably supporting the needle valve, a bell crank having one arm engaging the slide member for slidably moving the slide member, a bimetal cantilever having a free end for engaging the other end of the bell crank and moving the bell crank responsive to temperature change within the expansion chamber at a point downstream from the cold end, and an adjustable fulcrum member engaging the bimetal cantilever between its ends for adjusting the response of the bimetal cantilever to the desired cooling temperature of the cryogen.

* * * * *